United States Patent [19]

Glatz

[11] 4,279,412

[45] Jul. 21, 1981

[54] APPARATUS FOR ENGAGING AND MOVING INDIVIDUAL FLAT STRUCTURES, ESPECIALLY PAPER SHEETS OR PRINTED PRODUCTS

[75] Inventor: Werner Glatz, Hinwil, Switzerland

[73] Assignee: Ferag AG, Hinwil, Switzerland

[21] Appl. No.: 9,138

[22] Filed: Feb. 2, 1979

[30] Foreign Application Priority Data

Feb. 15, 1978 [CH] Switzerland ..... 1652/78

[51] Int. Cl.[3] ..... B65H 3/08

[52] U.S. Cl. ..... 271/108

[58] Field of Search ..... 271/108, 94, 95, 96

[56] References Cited

U.S. PATENT DOCUMENTS 3,414,452 12/1968 Smith ..... 271/95 X 3,937,458 2/1976 Langen ..... 271/95

FOREIGN PATENT DOCUMENTS 2625949 1/1977 Fed. Rep. of Germany ..... 271/108

1345981 2/1974 United Kingdom .

*Primary Examiner*—Richard A. Schacher

*Attorney, Agent, or Firm*—Werner W. Kleeman

[57] ABSTRACT

An apparatus for destacking a stack of flexible flat structures, especially paper sheets or printed products, comprising a suction head which can be moved, by means of a drive device, along a closed path of travel. This suction head is periodically connected, by means of a valve arrangement, with a source of negative pressure, and thereafter is again disconnected from such source. This valve arrangement comprises a cylindrical valve body attached to a drive shaft of the drive device for the suction head. This valve body rotates in a valve housing having three housing connections which, viewed in the direction of rotation of the valve body, are arranged behind one another. The forwardmost housing connection, viewed in such rotational direction, is connected with the negative pressure source, whereas the intermediate housing connection is connected with the suction head. The last housing connection serves for venting and is connected with the surroundings.

9 Claims, 5 Drawing Figures

APPARATUS FOR ENGAGING AND MOVING INDIVIDUAL FLAT STRUCTURES, ESPECIALLY PAPER SHEETS OR PRINTED PRODUCTS

BACKGROUND OF THE INVENTION

The present invention relates to a new and improved construction of apparatus for engaging and moving individual flat structures, especially paper sheets or printed products or the like.

The apparatus of the invention is of the type comprising at least one suction head which can be movably applied, by means of a drive device, at a respective flat structure for engagement therewith, the suction head entraining the engaged flat structure until it is released. Further, there is provided a valve arrangement, controlled by the drive device and connected with a negative pressure source at the suction head. The valve arrangement periodically connects or flow communicates the suction head with the negative pressure source in order to engage one of the flat structures. With such type equipment, as for instance is known from the German Patent Publication No. 27 32 591, the valve arrangement must periodically connect the suction head, moved along a closed path of travel, with the negative pressure source for a certain amount of time, so that the suction head can engage and entrain the flat structure which is to be moved. In order to be able to again release the engaged flat structure, the suction head again must be disconnected by the valve arrangement from the negative pressure source and vented. During each operating cycle of the suction head it is therefore necessary for the valve arrangement to firstly connect the suction head with the negative pressure source, thereafter to disconnect the suction head from the negative pressure source and to vent such suction head. In the case of high-speed equipment the valve arrangement therefore must be able, with short switching times, to faultlessly establish the requisite negative pressure at the suction head.

SUMMARY OF THE INVENTION

Therefore, with the foregoing in mind, it is a primary object of the present invention to provide a new and improved construction of apparatus of the previously mentioned type equipped with a valve arrangement which, while operating with short switching times and having relatively long service life, insures for a rapid build-up of the negative pressure or vacuum at the suction head.

Still a further significant object of the present invention aims at the provision of a new and improved construction of apparatus for engaging and moving individual flat structures, especially paper sheets or printed products, in a highly reliable, efficient and positive manner.

Yet a further significant object of the present invention is to devise apparatus for engaging and moving individual flat structures, especially paper sheets or printed products, which apparatus is relatively simple in construction and design, extremely reliable in operation, not readily subject to breakdown or malfunction, and requires a minimum of maintenance and servicing.

Now in order to implement these and still further objects of the invention, which will become more readily apparent as the description proceeds, the invention contemplates that the valve arrangement comprises a substantially cylindrical valve body rotatably mounted in a housing and revolvingly driven by the drive device or drive means. The valve body is provided with at least one recess extending over part of its circumference. The recess, during rotation of the valve body, periodically connects or flow communicates a first housing connection which is operatively coupled with the negative pressure source with a second housing connection which is connected with the suction head and thereafter again interrupts the connection between the first and second housing connections.

During rotation of the valve body the recess initially moves past the housing connection coupled with the negative pressure source, so that there can already occur a pressure reduction in the hollow space or compartment defined by the recess before the leading end of the recess reaches the housing connection coupled with the suction head. If thereafter this lastmentioned housing connection is coupled, by means of the recess, with the negative pressure source, then there already prevails in the space of the recess a negative pressure, contributing to the accelerated build-up of a negative pressure or vacuum at the suction head. This rapid establishment of a negative pressure is additionally augmented by the small flow losses in the valve arrangement. Since the valve body can be correspondingly rapidly driven, the switching time of the valve arrangement is shortened.

There is preferably provided at the housing a third connection serving for venting. This third connection, viewed in the direction of rotation of the valve body, is arranged at a spacing behind the second housing connection and after opening the flow communication or connection between the first and second housing connections can be connected by means of the recess of the valve body with the second housing connection. In this way there is rendered possible a rapid elimination of the negative pressure at the suction head. This is of importance as concern the sudden, time-proper and positionally-correct release of the engaged flat structure from the suction head.

It is particularly advantageous if the length of the recess, in the peripheral or circumferential direction of the valve body, is larger than the spacing between the first and second housing connections, since in this way there is maintained for a certain time the flow communication or connection between the negative pressure source and the suction head during the further rotation of the valve body. This renders possible, also with short switching times of the valve arrangement, a faultless establishment of the negative pressure at the suction head.

The valve body is advantageously secured to the drive shaft of the drive device for the suction head. This direct drive of the valve body enables a simple and space-saving construction of the valve arrangement, which, additionally, is positively synchronized with the movement of the suction head.

At both sides of the recess there are beneficially provided along the circumference of the valve body contactless seals, for instance labyrinth seals. Thus, there does not occur any contact, and therefore no wear, between the valve housing and the rotating valve body. This increases the service life of the valve arrangement even in the case of rapidly moving valve bodies.

The apparatus of the invention is preferably used in the environment of equipment for destacking a stack of flexible flat structures, for instance at a suction feeder.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
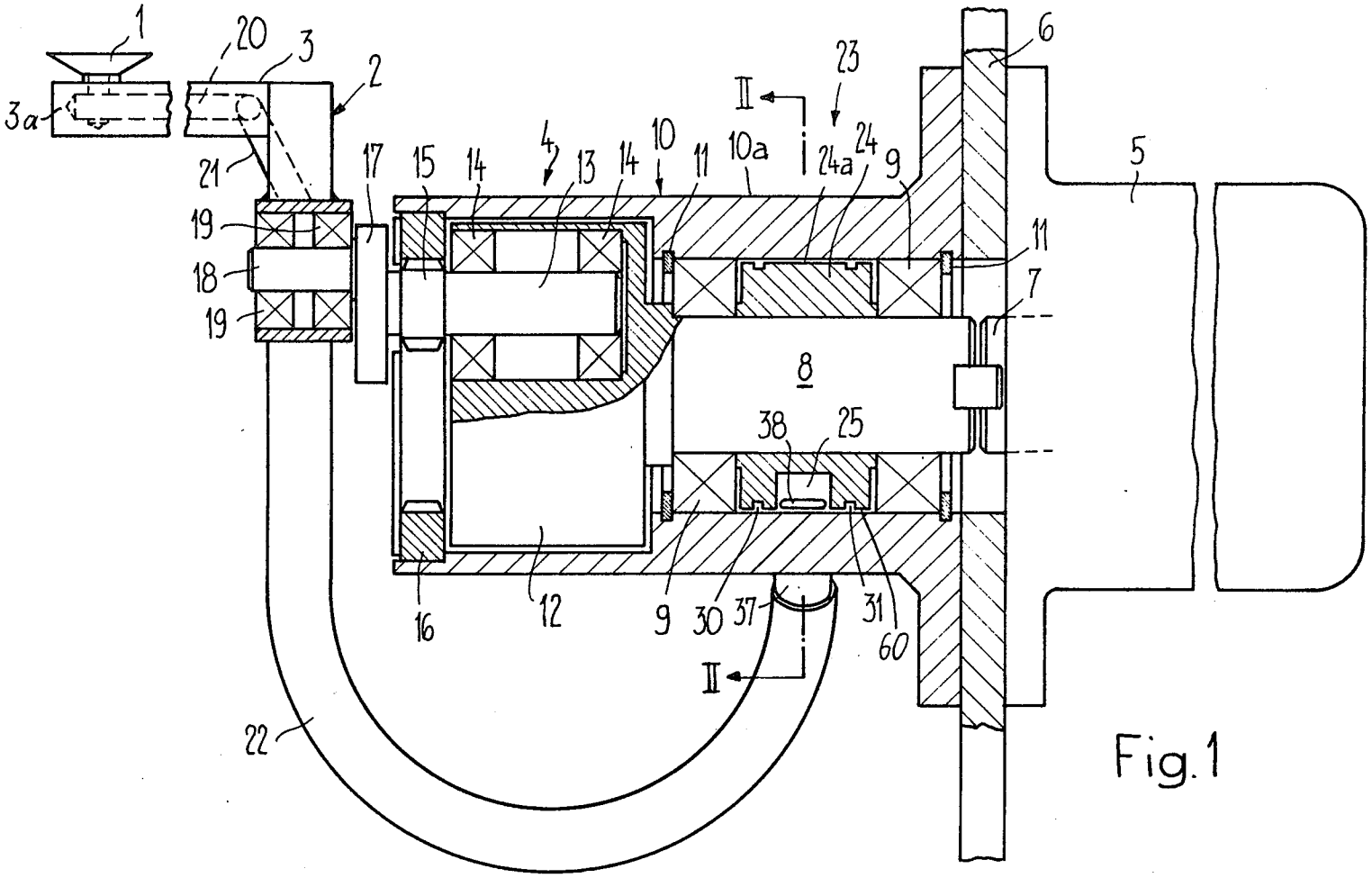
FIG. 1 is a fragmentary, side view, in section, showing a suction head with drive and valve arrangement according to the invention.

Describing now the drawings, it is to be understood that only enough of the structure of the apparatus for engaging and moving individual flat structures, especially paper sheets or printed products, has been shown in the drawings to simplify the illustration and as needed for one skilled in the art to readily understand the underlying principles and concepts of the invention. Turning attention specifically to FIG. 1, there is shown a suction head 1 or equivalent structure which is attached to the free end 3*a* of an offset arm 3 of an angle lever 2. The other arm of the angle lever 2, not illustrated in the showing of FIG. 1, is guided in a not particularly illustrated guide in a manner as has been explained more fully in the previously mentioned German Patent Publication No. 27 32 591, to which reference may be readily had and the disclosure of which is incorporated herein by reference. This angle lever 2, and thus, the suction head 1 are moved by means of a suitable drive device or drive means 4 along a closed path of travel or track. This drive device 4 comprises a drive motor 5 which is attached, for instance threadably connected to a wall 6. A drive shaft 7 of the drive motor 5 is coupled with a drive shaft 8 which is rotatably mounted by means of ball bearings 9 or equivalent structure in a bearing housing 10. The ball bearings 9 and thus the drive shaft 8 are secured against axial displacement by means of snap rings 11 or equivalent structure.

The drive shaft 8 carries at its end facing away from the drive motor 5 a disk 12 in which there is rotatably mounted, by means of ball bearings 14 or equivalent structure, a shaft 13 which is eccentrically arranged with regard to the drive shaft 8. A planetary gear 15 is seated upon this shaft 13. This planetary gear 15 meshes with an internally toothed rim or inner gearing means 16 mounted in the bearing housing 10. At its end protruding past this housing 10 the shaft 13 is provided with a disk 17 at which there is arranged a journal pin or pivot pin 18 which is eccentrically arranged in relation to the shaft 13. This journal or pivot pin 18 is arranged with regard to the shaft 13 such that the axis of the journal pin 18 approximately intersects the rolling circle of the planetary gear 15, so that the pivot or journal pin 18 moves along an essentially hypocycloidal-shaped revolving path of travel. The angle lever 2 is rotatably mounted a the journal pin 18 by means of the ball bearings 19 or equivalent structure. By means of the described drive device 4 the suction head 1 is moved along a path of travel or orbit having the shape of an hypocycloid extended in the direction of one tip, as such has been more fully disclosed in the aforementioned German Patent Publication No. 27 32 591.

A bore 20 is provided at the arm 3, by means of which the suction head 1 is connected with a suction line or conduit 21. Connected with the suction line 21 is a connection line or conduit 22 which is coupled at its other end with a valve arrangement or valve means 23, to be discussed more fully hereinafter. This valve arrangement 23 comprises a valve housing 10*a* which, for the illustrated exemplary embodiment, is constructed as part of the bearing or support housing 10. Located within this valve housing 10*a* is a substantially cylindrical valve body 24 which is pressed onto the drive shaft 8 of the drive device 4 and can be revolvingly driven by this drive shaft 8. The valve body 24 is dimensioned such that only a very small radial play exists between its circumferential surface 24*a* and the valve housing 10*a*. The valve body 24 possesses a recess or depression 25 or equivalent structure which extends over part of its circumference, recess 25 opening in the direction of the circumferential or peripheral surface 24*a*. The base surface or base 25*a* of the recess 25, in the illustrated exemplary embodiment, is bounded by two planes which mutually enclose an obtuse angle, as such will be apparent from the showing of FIGS. 2 to 5.

Furthermore, it will be seen that at its leading and trailing ends the recess or recess means 25 is provided at its base surface 25*a* with a respective notch or cut-out 26 and 27 extending transversely with respect to the direction of rotation A of the valve body 24. Each notch 26 and 27 defines a wiper edge 28 and 29, the function of which will be explained more fully hereinafter. At each side of the recess 25 there is formed, at the circumferential surface 24*a* of the valve body 25, a respective ring-shaped or annular groove 30 and 31 serving as a labyrinth gap seal or labyrinth seal means. By means of such contactless seals the recess 25 is laterally sealed. Between the revolving valve body 24 and the valve housing 10*a* there thus does not occur any contact at any location, as clearly shown in FIG. 1, with the result that there are beneificially avoided wear or abrasion phenomena due to friction, and thus increasing the surface life. The small spacing 60 (FIG. 1) between the revolving valve body 24 and the inner wall of the valve housing 10*a* is not shown in FIGS. 2 to 5 but should be assumed to exist.

Figure 2:
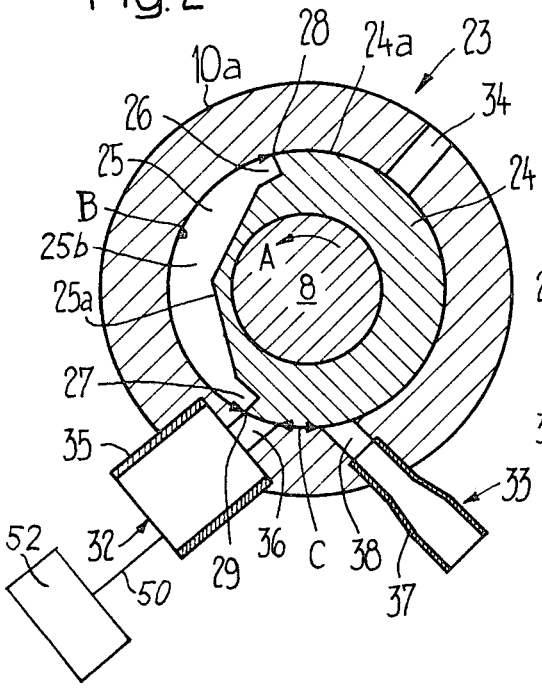
FIGS. 2, 3, 4 and 5 constitute respective sectional views, taken along the line II—II of FIG. 1, wherein each such Figure shows the valve body in a different rotational position.
Figure 3:
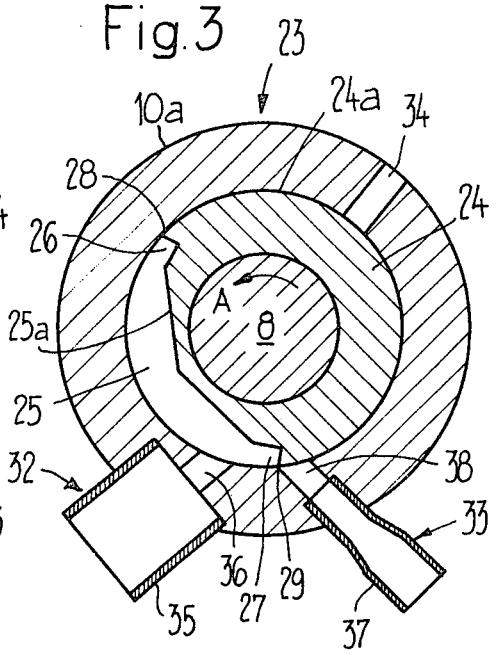
Figure 4:
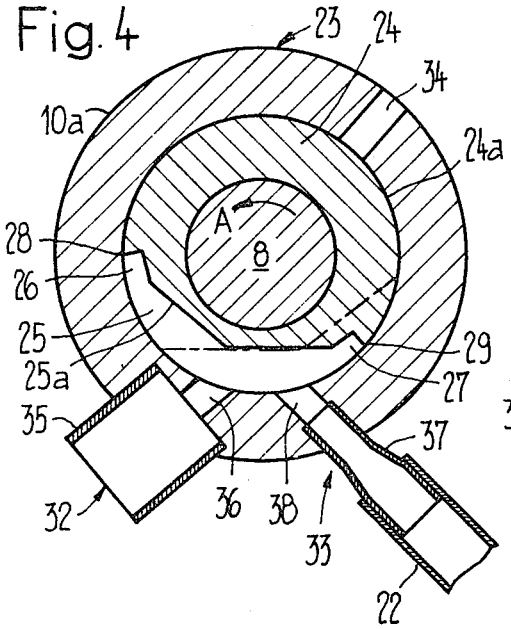
Figure 5:
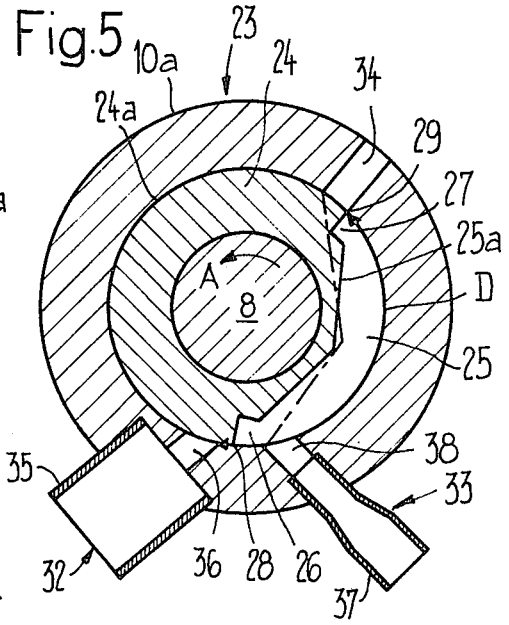

As particularly well seen by referring to FIGS. 2 to 5, the valve housing 10*a* has three housing connections or connection means 32, 33 and 34 which are arranged after one another, viewed in the direction of rotation A of the valve body 24. The housing connection 32 consists of a tubular stud or connection piece 35 secured in the housing 10*a*, this connection piece 35 being coupled by means of a bore 36 with the housing interior. This housing connection 32 is secured by means of a connection line or conduit, generally schematically indicated by reference character 50 and attached at the tubular connection piece, 35 with a likewise only schematically illustrated negative pressure source 52 which is of standard construction. The subsequent housing connection 33 likewise possesses a tubular connection piece 37 which is attached at the housing 10*a*. This tubular connection piece 37 flow communicates by means of a bore 38 with the interior of the valve housing 10*a*. This housing connection 33 is coupled by means of the connection line or conduit 22, secured at the tubular connection piece 37, with the suction head 1, as such has been illustrated in FIGS. 1 and 4. The third housing connection 34, structured as a continuous venting bore, connects or flow communicates the interior of the valve housing 10*a* with the atmosphere. As best seen by referring to FIG. 2, the length B of the recess 25, measured in the circumferential direction of the valve body 24, is larger than the spacing C between the housing connections 32 and 33 (FIG. 2). Furthermore, the aforementioned length B of the recess 25 is smaller than the spacing D between the housing connections 32 and 34 (FIG. 5).

Now on the basis of the illustrations of FIGS. 2 to 5 there will be now explained more fully the mode of operation of the valve arrangement or valve means 23. As mentioned, the valve body 24 is continuously driven by the drive shaft 8 in the direction of the arrow A. In the rotational position of the valve body 24, illustrated in FIG. 2, all three housing connections 32, 33 and 34 are closed by the valve body 24. If the valve body 24 is further rotated into the rotational position illustrated in FIG. 3, then initially there is freed the housing connection 32. The recess 25 thus is in flow communication with the negative pressure source 52, so that within the hollow space or compartment 25*b* defined by the recess 25 there forms a negative pressure or vacuum, before there is freed the next following housing connection 33. In the rotational position of the valve body 24, shown in FIG. 4, the recess 25 now flow communicates or interconnects both of the housing connections 32 and 33. Thus, the suction head 1 is connected with the negative pressure source 52, and the negative pressure at the suction head 1 can build-up extremely rapidly, since, on the one hand, the flow losses in the valve arrangement 23 are extremely small, and, on the other hand, as already mentioned, a negative pressure prevails in the recess 25 before there is established the connection between both of the housing connections 32 and 33. Since the length B of the recess 25 is greater than the spacing C between the housing connections 32 and 33 there is maintained for a certain time the connection or flow communication between the housing connections 32 and 33 also during further rotation of the valve body 24, as such has been indicated in FIG. 4 with the broken line illustrated rotational position of the valve body 24. FIG. 5 shows the valve body 24 in a rotational position where it closes the housing connection 32, but however has not yet freed the housing connection 34. As mentioned, this is achieved in that the length B of the recess 25 is smaller than the spacing D between the housing connections 32 and 34. In this way there is achieved the result that the connection or flow communication between the housing connections 32 and 33 is interrupted before the housing connection 33 is connected by means of the recess 25 with the housing connection 34. In the rotational position of the housing body 24 shown in FIG. 5 in broken lines, the recess 25 connects the housing connection 33 with the housing connection 34. In this way the suction head 1 is exposed to atmospheric pressure, causing annihilation of the negative pressure at the suction head 1. During further rotation of the valve body 24 there are now again closed in succession also the housing connections 33 and 34 and the valve body 24 returns back to the rotational position illustrated in FIG. 2.

The rotational movement of the valve body 24 is synchronized with the movement of the suction head 1, as such has been fully explained in the already mentioned German Patent Publication No. 27 32 591. The suction head 1 is applied by means of the drive device 4 to a flat structure (not shown) or the like, which it thus engages due to the negative pressure or vacuum prevailing thereat and entrains such along its wide path of travel. The seized flat structure is released by the suction head 1 as soon as the latter is again exposed to the atmospheric pressure by the valve arrangement 23.

It is possible that, upon application of a negative pressure at the suction head 1, solid particles may enter the housing connection 33 and the gap 60 between the valve body 24 and valve housing 10*a*. In order to avoid any seizing or jamming of these particles, there are provided the aforementioned wiping or wiper edges 28 and 29. In particular, the trailing wiper edge 28 serves for cleaning the inner wall of the valve housing 10*a* and for shearing particles at the inner edge of the bore 38 which protrude past such bore.

The previously described apparatus is preferably incorporated into equipment for destacking a stack of flexible flat structures, especially unfolded or folded sheets or printed products, as the same has been described in the aforementioned German Patent Publication No. 27 32 591. Yet, this apparatus can also be employed in other types of suction feeders. If there are provided a number of suction heads, then there can be provided for each suction head its own valve arrangement of the aforementioned type. However, it is also conceivable to provide for all of the suction heads a common valve arrangement, wherein the valve body possesses a number of adjacently situated recesses, with each of which there is operatively associated a suction head and cooperating with appropriate housing connections in the valve housing, as the same has already been previously described. In this regard it can be advantageous not to secure the valve body upon the drive shaft of the drive device for the suction head, rather to drive the valve body through the agency of intermediate gearing by the drive device of the suction head.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for destacking a stack of flexible flat structures, especially paper sheets or printed products, comprising:

a suction head movable into engagement with a flat structure for seizing the same and entraining such flat structure until release thereof;

drive means for moving said suction head into engagement with the flat structure and for moving such suction head through a predetermined path of travel;

said drive means includes a drive shaft coupled with a driving arrangement;

a source of negative pressure;

valve means operatively connected with said source of negative pressure and said suction head;

said valve means being controlled by said drive means;

said valve means operatively connecting the suction head for a certain time with the negative pressure source in order to engage the flat structure by means of the suction head;

said valve means comprising a substantially cylindrical valve body;

said valve body being secured to said drive shaft;

a stationary housing within which there is rotatably mounted said valve body;

said valve body having a recess extending in the direction of and over part of its circumference and being open towards said housing;

said housing having a first housing connection operatively connected with said negative pressure source and a second housing connection operatively connected with said suction head;

said second housing connection, viewed in the direction of rotation of the valve body, being spaced apart from and lying behind said first housing connection;

said housing further having a third housing connection serving for venting;

said third housing connection, viewed in the direction of rotation of the valve body, being arranged in spaced relationship behind said second housing connection;

said recess, during rotation of said valve body, at first connecting the first housing connection with the second housing connection, thereafter interrupting the connection between the first housing connection and the second housing connection and connecting the second housing connection with the third housing connection.

2. The apparatus as defined in claim 1, wherein:

the length of the recess, viewed in the circumferential direction of the valve body, is greater than the spacing between the first housing connection and the second housing connection.

3. The apparatus as defined in claim 1, wherein:

said recess has a leading end and a trailing end; and said recess being provided at least at the region of its trailing end with a wiper edge extending transversely with respect to the direction of rotation of the valve body.

4. The apparatus as defined in claim 3, wherein:

said recess has a base surface;

said valve body being provided at least at the trailing end of the recess at the base surface of said recess with a notch extending substantially transversely with respect to the direction of rotation of the valve body and adjacent to the housing; and said notch defining said wiper edge.

5. The apparatus as defined in claim 1, further including:

contactless seal means provided to both sides of said recess along the circumference of the valve body.

6. The apparatus as defined in claim 5, wherein:

the seal means at each side of the recess comprises at least one substantially ring-shaped groove provided at the valve body.

7. The apparatus as defined in claim 1, wherein:

said apparatus is incorporated into equipment for destacking a stack of flexible flat structure.

8. The apparatus as defined in claim 1, further including:

a bearing housing;

two bearing means arranged in said bearing housing for guiding said drive shaft;

said valve body being arranged between said bearing means.

9. The apparatus as defined in claim 1, further including:

gear means operatively coupled with said drive shaft and said suction head;

said valve means being arranged between said gear means and said driving arrangement.

* * * * *